US006710315B2

(12) United States Patent
Chisholm

(10) Patent No.: US 6,710,315 B2
(45) Date of Patent: Mar. 23, 2004

(54) HAND-HELD FOOD PACKAGE

(75) Inventor: Gary Chisholm, Rancho Palos Verdes, CA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/037,424

(22) Filed: Oct. 29, 2001

(65) Prior Publication Data

US 2003/0080117 A1 May 1, 2003

(51) Int. Cl.[7] ..... H05B 6/80
(52) U.S. Cl. ..... 219/730; 219/732
(58) Field of Search ..... 219/730, 725, 219/732, 735, 727, 728, 729, 686; 426/118, 234, 107, 109, 241, 243, 113; 383/100, 103, 204; 428/35.8; 229/123.2, 125.35, 903; 99/DIG. 14

(56) References Cited

U.S. PATENT DOCUMENTS

| | | | | |
|---|---|---|---|---|
| 2,617,549 | A | | 11/1952 | Egger |
| 3,785,254 | A | | 1/1974 | Mann |
| 3,908,523 | A | | 9/1975 | Shikaya |
| 3,961,569 | A | | 6/1976 | Kenyon et al. |
| 4,080,880 | A | | 3/1978 | Shikaya |
| 4,155,895 | A | | 5/1979 | Rohowetz et al. |
| 4,435,344 | A | | 3/1984 | Iioka |
| 4,638,911 | A | * | 1/1987 | Prohaska ..... 383/205 |
| 4,641,005 | A | | 2/1987 | Seiferth |
| 4,725,329 | A | * | 2/1988 | Tani ..... 156/436 |
| 4,775,771 | A | | 10/1988 | Pawlowski et al. |
| 4,780,587 | A | | 10/1988 | Brown |
| 4,825,025 | A | | 4/1989 | Seiferth |
| 4,848,649 | A | | 7/1989 | Fuller et al. |
| 4,948,932 | A | | 8/1990 | Clough |
| 5,009,326 | A | | 4/1991 | Reaves et al. |
| 5,038,009 | A | | 8/1991 | Babbitt |
| 5,092,485 | A | | 3/1992 | Lee |
| 5,114,068 | A | | 5/1992 | Reil et al. |
| 5,158,499 | A | * | 10/1992 | Guckenberger ..... 206/524.2 |
| 5,205,473 | A | | 4/1993 | Coffin, Sr. |
| 5,215,249 | A | | 6/1993 | Gorrieri |
| 5,241,150 | A | | 8/1993 | Garvey et al. |
| 5,254,821 | A | | 10/1993 | Walters |
| 5,300,746 | A | | 4/1994 | Walters et al. |
| 5,411,202 | A | | 5/1995 | Fenini |
| 5,464,969 | A | | 11/1995 | Miller |
| 5,530,231 | A | | 6/1996 | Walters et al. |
| 5,698,127 | A | | 12/1997 | Lai et al. |
| 5,772,111 | A | | 6/1998 | Kirsch |
| 5,826,786 | A | | 10/1998 | Dickert |
| 5,830,548 | A | | 11/1998 | Andersen et al. |
| 5,839,653 | A | | 11/1998 | Zadravetz |
| 6,054,698 | A | | 4/2000 | Mast |
| 6,102,281 | A | | 8/2000 | Lafferty et al. |
| 6,114,679 | A | | 9/2000 | Lai et al. |
| 6,133,560 | A | | 10/2000 | Zeng et al. |
| 6,150,646 | A | | 11/2000 | Lai et al. |
| 6,196,408 | B1 | | 3/2001 | Setty et al. |
| 6,251,451 | B1 | | 6/2001 | Zeng |
| 6,259,079 | B1 | | 7/2001 | Ji et al. |
| 6,261,611 | B1 | | 7/2001 | Berman |
| 6,386,438 | B1 | | 5/2002 | Walsh et al. |
| 2002/0037344 | A1 | | 3/2002 | Gibernau |

FOREIGN PATENT DOCUMENTS

| | | |
|---|---|---|
| EP | 1190960 | 3/2002 |
| GB | 2352706 | 2/2001 |
| JP | 2001353069 | 12/2001 |

* cited by examiner

*Primary Examiner*—Quang T. Van
(74) *Attorney, Agent, or Firm*—Fulbright & Jaworski, L.L.P.

(57) ABSTRACT

The present invention is directed to a convenient semi-rigid hand-held microwaveable package. The package contains a thermal insulating layer that protects the consumer from being burned by handling the hot package. Yet further, the package also contains an easy open device.

27 Claims, 12 Drawing Sheets

HAND-HELD FOOD PACKAGE

FIELD OF THE INVENTION

The present invention relates to a hand-held package for use as a convenient microwaveable food container. More particularly, the package includes a thermal insulating surface to protect the consumer from the hot food item. Another aspect of the hand-held package is an easy open tear strip device.

BACKGROUND OF THE INVENTION

The use of microwave energy for cooking has been available for many years. Microwave shielding material is known in the art to shield microwave energy from a food product or to focus microwave energy to a particular portion of a food product in order to cook the food. Microwave susceptor materials are known in the art and are used in microwave cooking apparatuses for directly heating food and for browning by conduction from the microwave susceptor material heated by the absorption of microwaves.

The self-venting microwaveable package disclosed in U.S. Pat. No. 5,464,969 is a microwaveable plastic bag for heating a variety of products including liquids. One seam of the bag incorporates a strip seal that vents when enough pressure is generated in the bag in order to prevent explosion of the bag.

A multi-layer microwave conductive structure is disclosed in U.S. Pat. No. 5,530,231, which is incorporated herein by reference. The disclosed conductive structure for use in microwave food packaging adapts itself to heat food articles in a safer, more uniform manner. The structure includes a conductive layer disposed on a non-conductive substrate. An aspect of the structure's conductive layer of links and base areas causes microwave induced current to be channeled through the links resulting in controlled heating.

Metallized microwave diffuser films are disclosed in U.S. Pat. No. 5,300,746, which is incorporated herein by reference. The films include an insulative substrate, having a first side upon which is deposited a metallic coating capable of selectively reflecting a portion of incoming microwave energy.

Those systems, which disclose vessels for heating or cooking using microwave energy or disclose materials which reflect microwave energy or become hot upon contact with microwave energy transmission, may be used to heat and cook food products adequately, however, the vessels that contain the food become extremely hot. The present microwaveable packages are time consuming and inefficient. Time is lost in waiting for the vessel or container to cool before it can be handled. Further, additional resources or packages are used to transfer the hot food item to another receptacle that can be held.

Therefore, there is a need in the art for a microwave cooking package system which may be used to cook a fresh, frozen or refrigerated, cooked or uncooked food item in a microwave oven that is safe to be held by the consumer upon withdrawing the food item container from the microwave oven, does not burn the consumer, and is easy to open. Thus, the present invention allows for immediate handling of the container and eliminates the need for additional receptacles to hold the hot food item.

BRIEF SUMMARY OF THE INVENTION

The present invention is directed to a hand-held package for use as a convenient microwaveable food container.

Specifically, the package comprises an easy open device, and is insulated to protect the consumer from the hot food item.

One embodiment of the present inventions is a container for cooking a food item using microwaves that includes a sealed container for microwave cooking, a mechanically formed weakness in a seal of the container that ruptures and vents the container when hot gases within the container cause the interior pressure or temperature to exceed a certain level. A microwave susceptor surface positioned as an inner surface of the container, including a substrate having a microwave-absorptive coating region, and a thermal insulating surface.

Another embodiment of the present invention is a container for cooking a food item using microwaves that includes a sealed container for microwave cooking and a mechanically formed weakness in a seal of the container that ruptures and vents the container when hot gases within the container cause the interior pressure or temperature to exceed a certain level. A microwave susceptor surface is positioned as an inner surface of the container, that includes a substrate having a microwave-absorptive coating region; a thermal insulating surface which protects the consumer from being burned from the hot item after cooking in a microwave oven; and a tear-strip easy open device. The tear-strip allows for easy and convenient access to the food item after cooking in a microwave oven.

Another embodiment of the present invention is a hand-held food package having a microwave susceptor surface positioned as an inner surface of the container that includes a substrate having a microwave-absorptive coating region and a thermal insulating surface which protects the consumer while handling the package. The microwave-absorptive region is deposited, printed, extruded, or laminated on the substrate.

The foregoing has outlined rather broadly the features and technical advantages of the present invention in order that the following detailed description of the invention may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only, and is not intended as a definition of the limits of the present invention.

BRIEF DESCRIPTION OF THE DRAWINGS

For a more complete understanding of the present invention, reference is now made to the following descriptions taken in conjunction with the accompanying drawings.

DETAILED DESCRIPTION OF THE INVENTION

It is readily apparent to one skilled in the art that various embodiments and modifications can be made to the invention disclosed in this Application without departing from the scope and spirit of the invention.

As used herein, the use of the word "a" or "an" when used in conjunction with the term "comprising" in the sentences and/or the specification can mean "one," but it is also consistent with the meaning of "one or more," "at least one," and "one or more than one."

Referring now in more detail to the drawings, in which like numerals refer to like parts throughout several views, the container 10 for a food item 30 includes an easy open device including a tear-strip 21 which is connected to a gripping tab 20. The microwaveable food container 10 preferably is a semi-rigid container. For example, the container is preferably constructed using semi-stiff materials, such as cardboard, pulp paper, pressed paper, corrugated paper, plastic, laminates, or other semi-pliable materials.

The food item 30 may be any food that can be fresh, frozen, or chilled and thereafter microwaved for human consumption. It is also envisioned that the food item 30 may be a pet food for consumption by a companion animal.

Figure 1A:
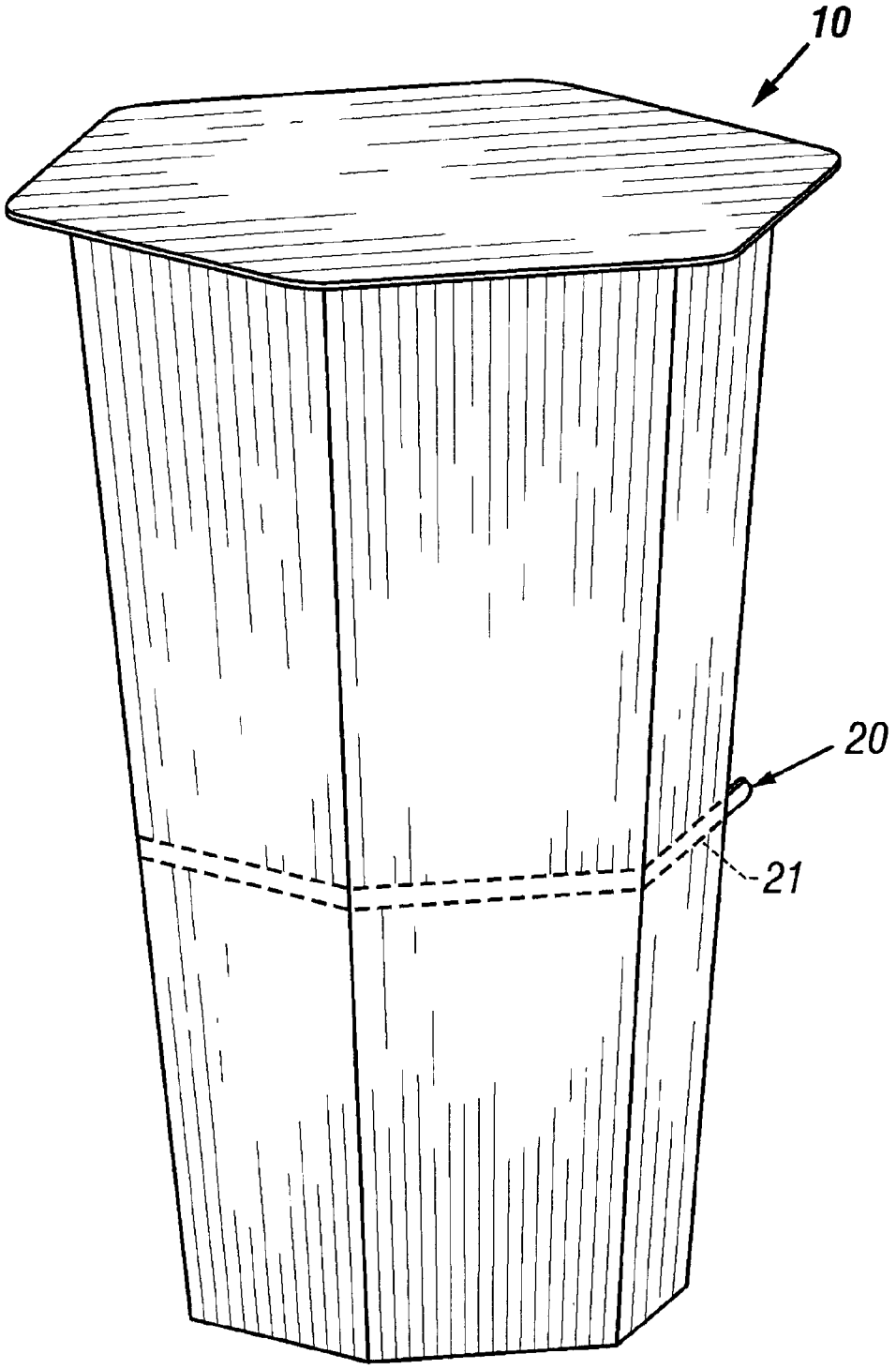
FIG. 1A and FIG. 1B illustrate a container comprising the tear-strip in alternative locations of the present invention.
Figure 1B:
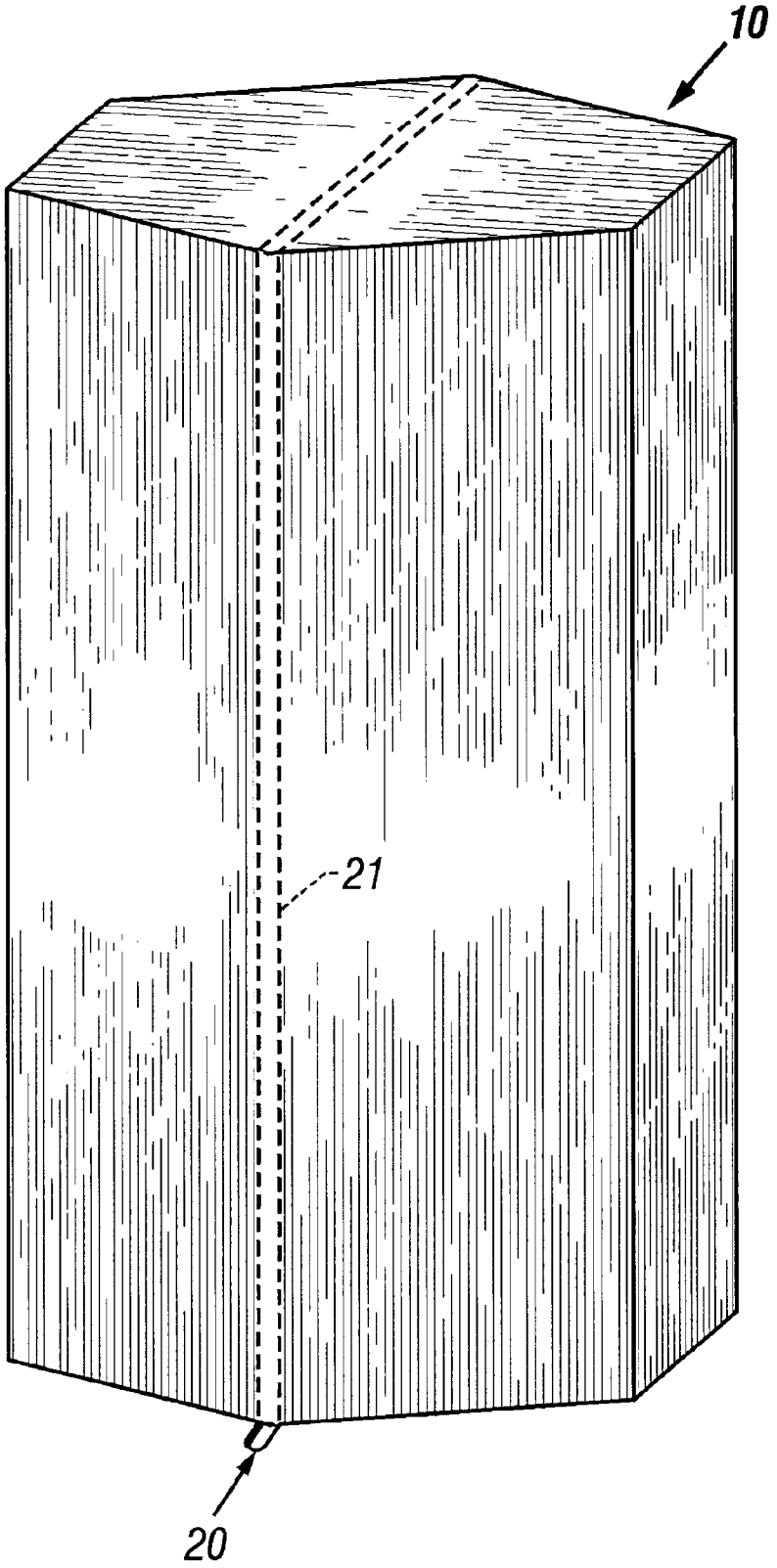
Figure 2C:
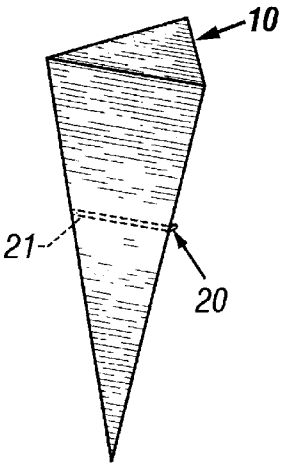
FIG. 2A, FIG. 2B, FIG. 2C, FIG. 2D, FIG. 2E and FIG. 2F illustrate a variety of possible shapes for the container of the present invention.
Figure 2B:
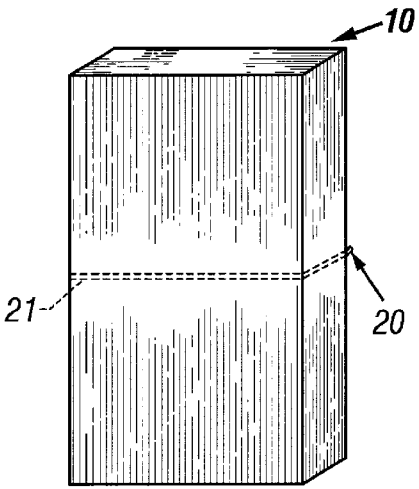
Figure 2A:
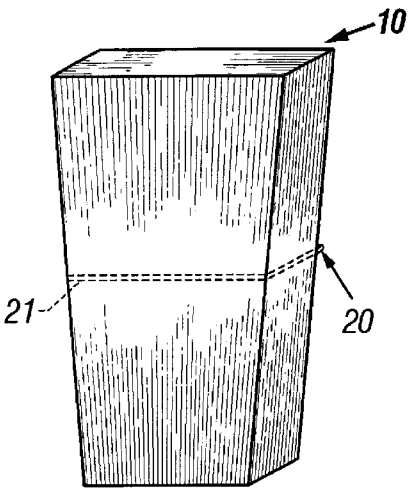
Figure 2F:
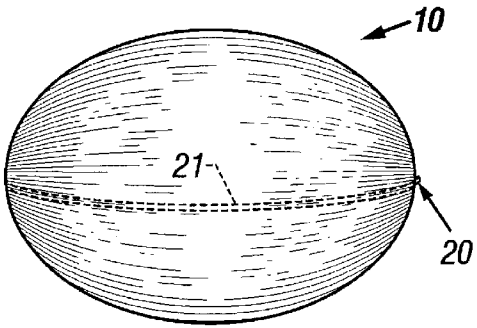
Figure 2E:
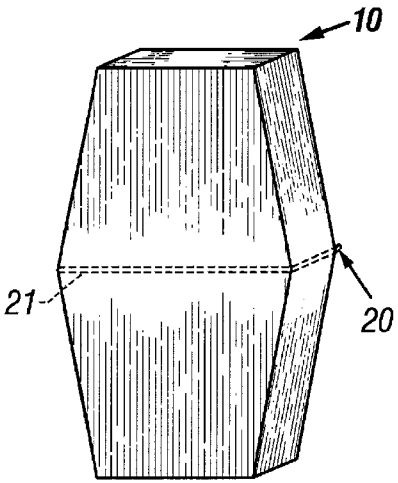
Figure 2D:
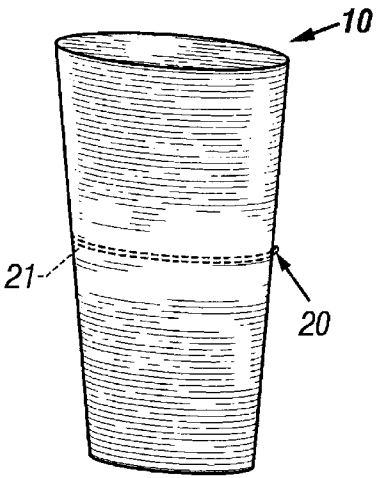

As shown in FIG. 1A and FIG. 1B the tear-strip 21 and gripper tab 20 can be positioned either horizontally (FIG. 1A) or vertically (FIG. 1B) around the food container 10. The present invention is not limited to the positioning of the tear-strip 21 and gripper tab 20 as it is understood that the tear-strip 21 and gripper tab 20 may be positioned at any location on the container in order to provide an adequately sized container necessary to perform as a receptacle for any given food item for the consumer. It is also understood that the tear-strip 21 can wrap around the entire container or partially wrap around the container.

FIG. 2A–FIG. 2F illustrates various shapes of containers that are contemplated in the present invention. Exemplary shapes include, but are not limited to a polyhedron, a cylinder, a prism, sphere, ellipsoid, circular or egg-shaped, or a variant thereof. As used herein, the term polyhedron refers to a solid object or a three-dimensional object bounded by polygons, which is a closed plane figure bounded by three or more line segments. A cylinder of the present invention refers to a solid bounded by two parallel planes with a surface having a circle as a directrix. Yet further, a prism of the present invention includes a solid figure whose bases or ends have the same size and shape, and are parallel to one another and each of whose sides is a parallelogram. A sphere of the present invention refers to a three-dimensional object that has all points equidistant from a fixed point. An ellipsoid of the present invention relates to an object having plane sections that are either ellipses or circles.

Figure 3A:
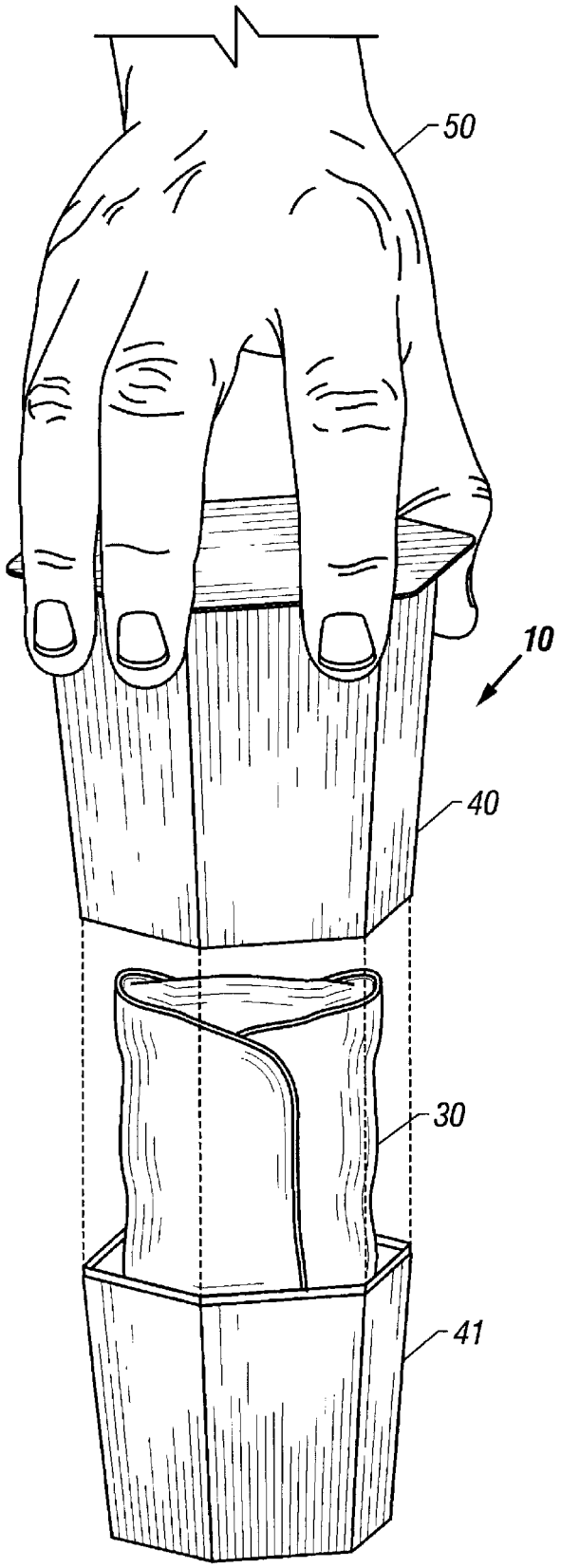
FIG. 3A and FIG. 3B illustrate the container in an open position in which the container is separated into two parts.
Figure 3B:
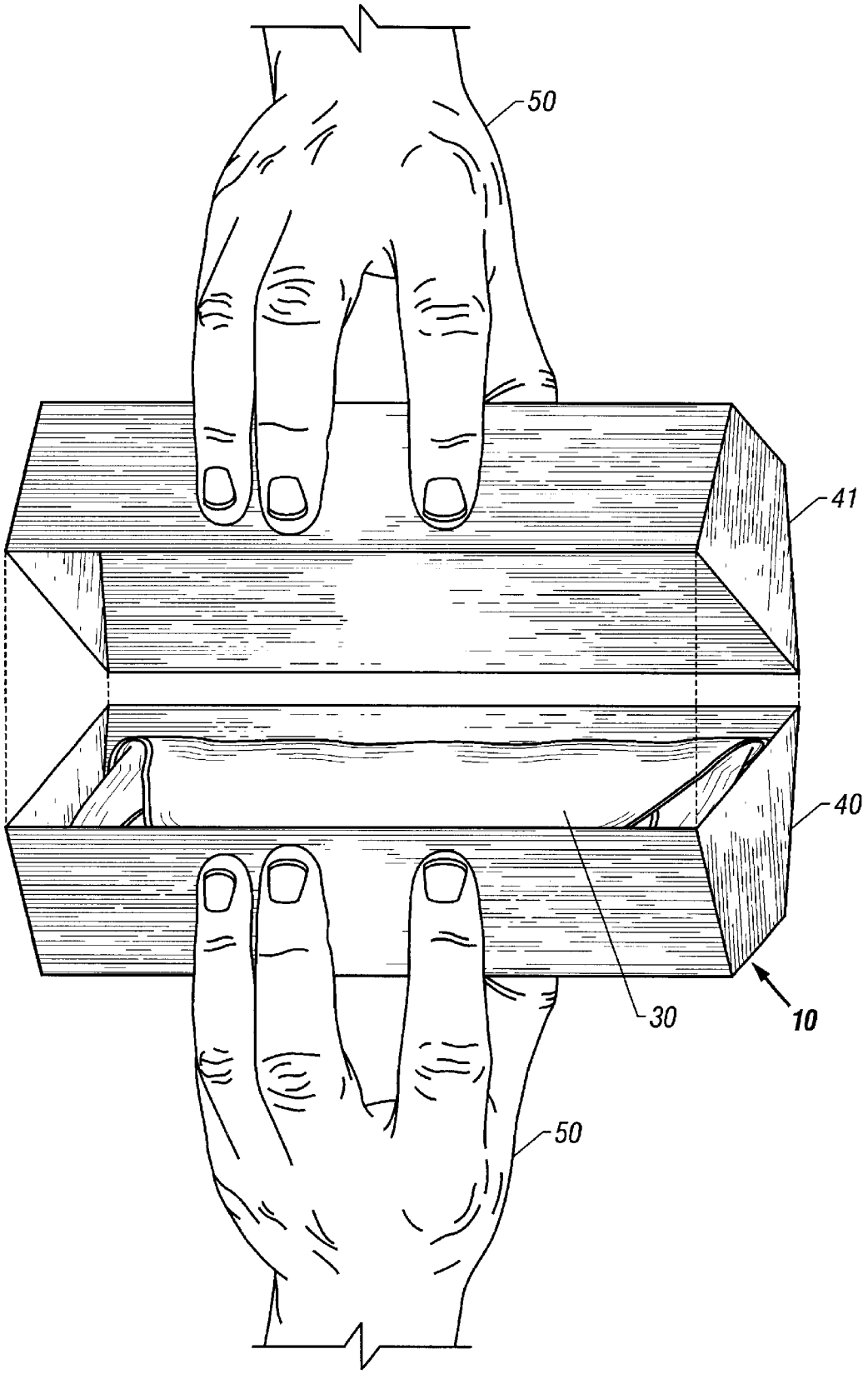
Figure 4:
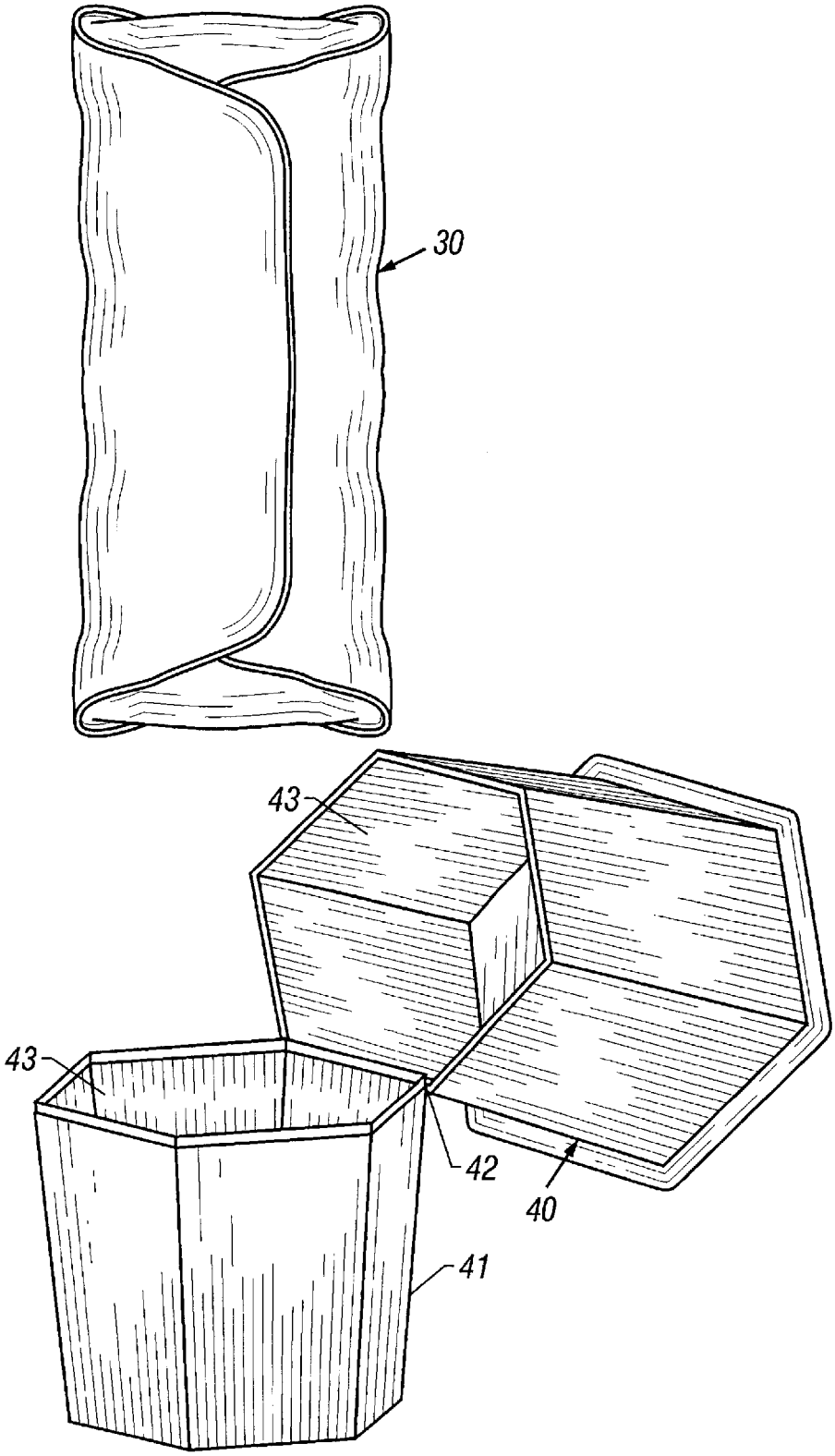
FIG. 4 illustrate the container in an open position in which the container is not separated into parts.

Referring to FIG. 3A, FIG. 3B and FIG. 4, the food container, 10 containing a food item 30 of the present invention, can be separated into two parts 40, 41. The separation of the container 10 occurs via a tear-strip 21 of which is positioned horizontally or vertically on the container. The tearing action results in a separation of the container into two parts 40, 41. Complete separation is not essential. In fact, the container may only be partially separated having an opening 43 and a hinge 42 to allow the consumer to use both portions of the container 10 for receptacles of food items or other items, such as condiments.

Figure 5A:
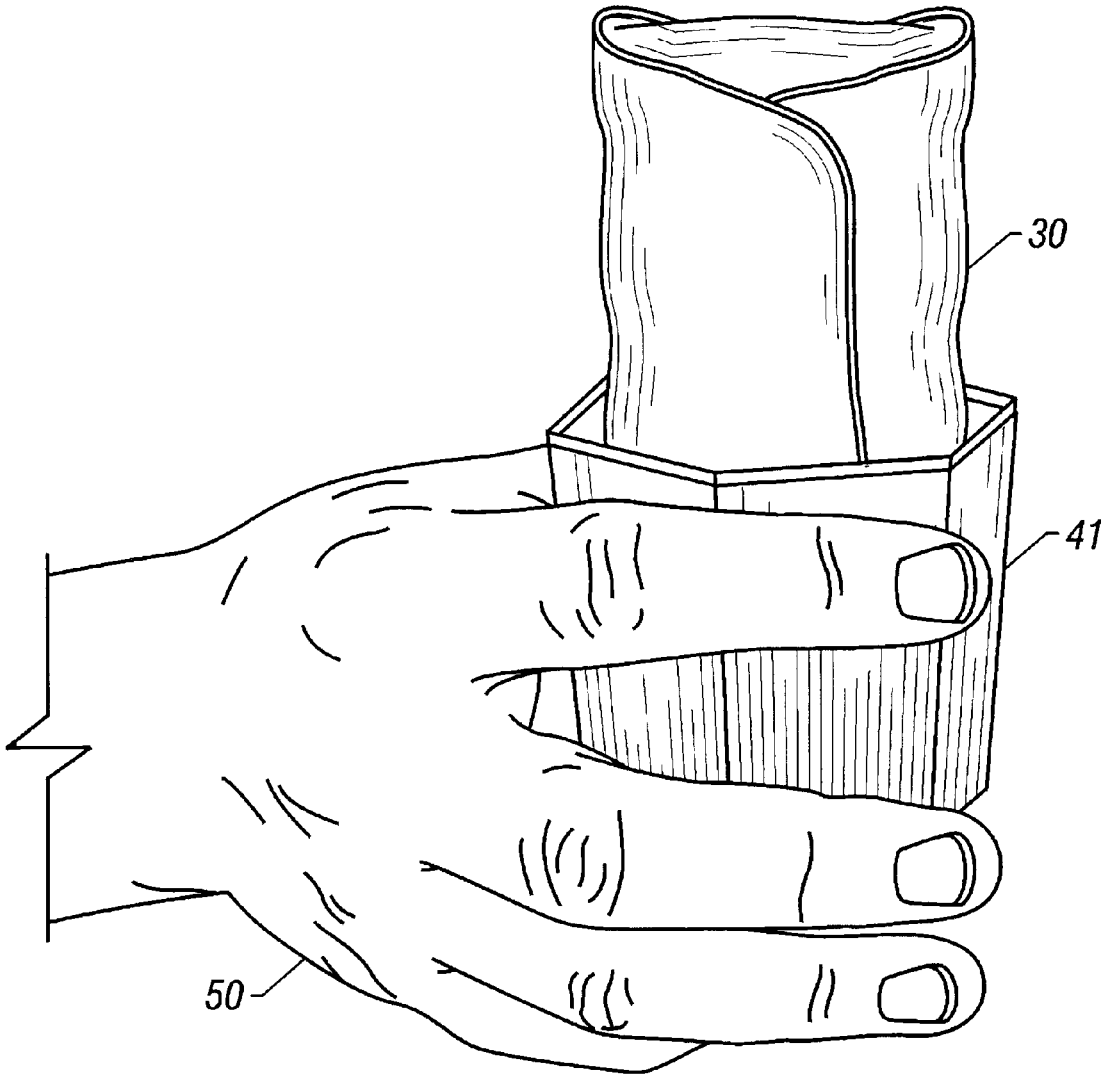
FIG. 5A and FIG. 5B illustrate that the container can be held by one hand for consumption.
Figure 5B:
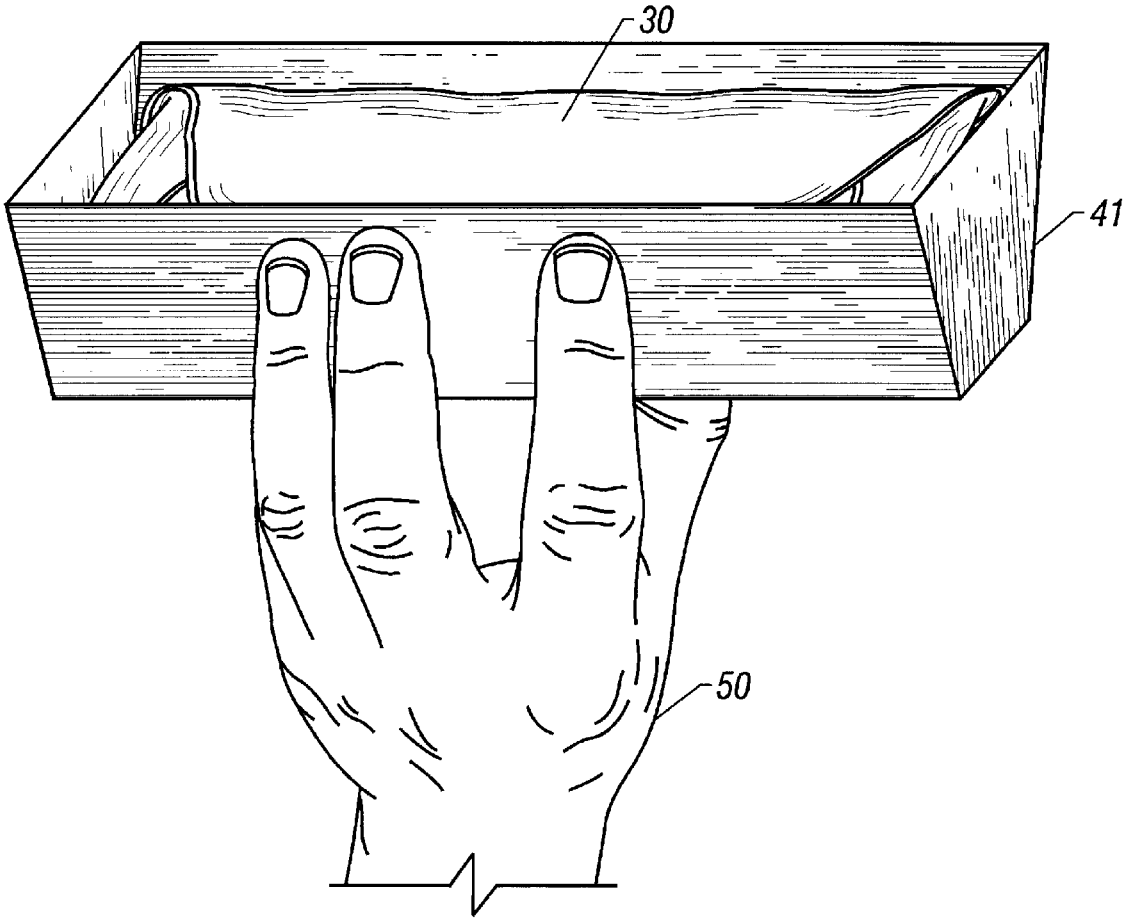

As shown in FIG. 5A and FIG. 5B, the present invention is designed to be held in one hand 50 while eating the food item. For example, the consumer microwaves the container having a food item, tears open the container and removes the top part 40, and holds the bottom part 41 of the container to consume the hot food item. The benefit of the present invention is that the consumer does not have to wait for the container to cool before it can be held. In fact, the container can be removed immediately from the microwave oven and held in one hand without burning the hand of the consumer.

Figure 6A:
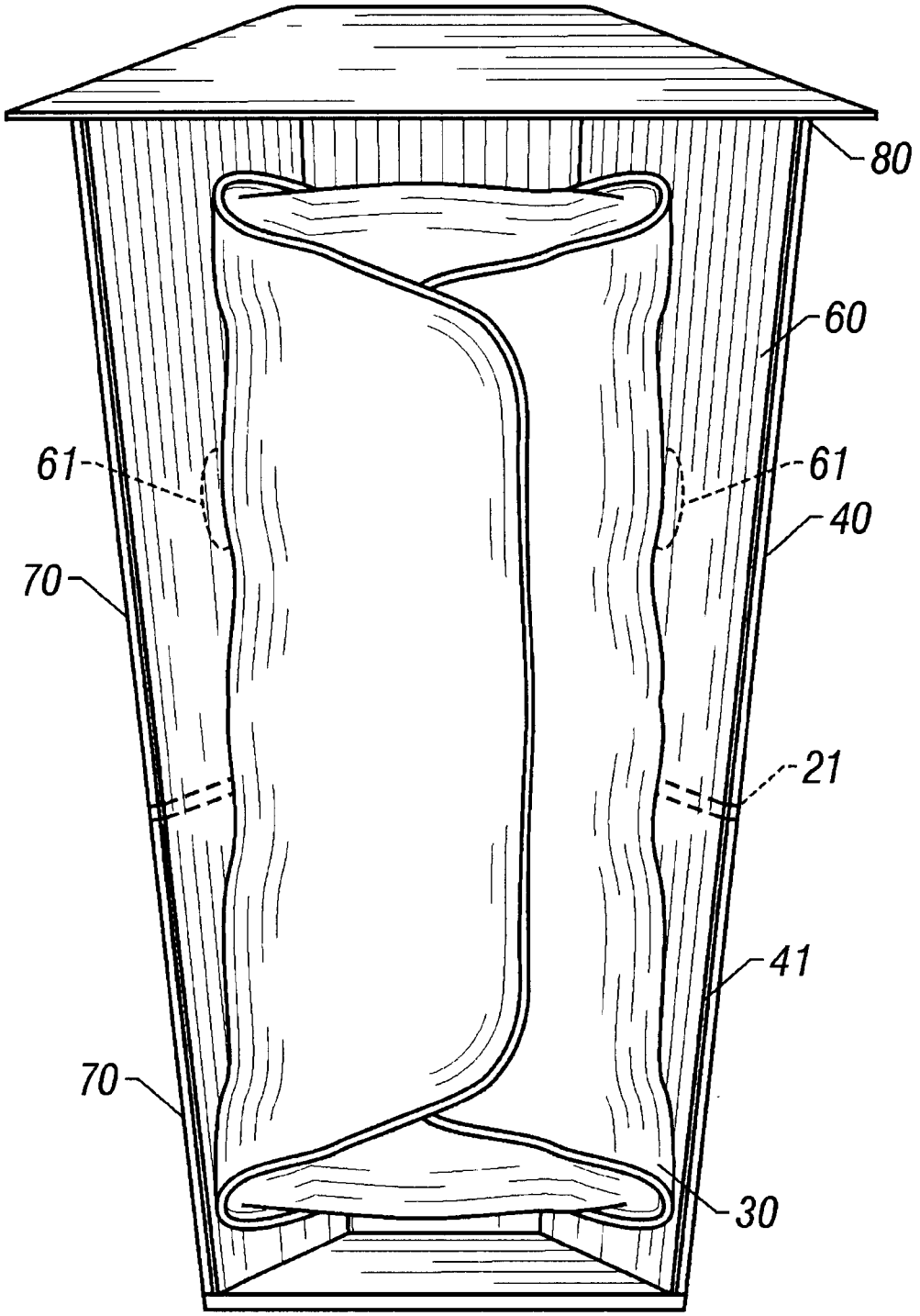
FIG. 6A and FIG. 6B illustrate a cross-sectional of the container.
Figure 6B:
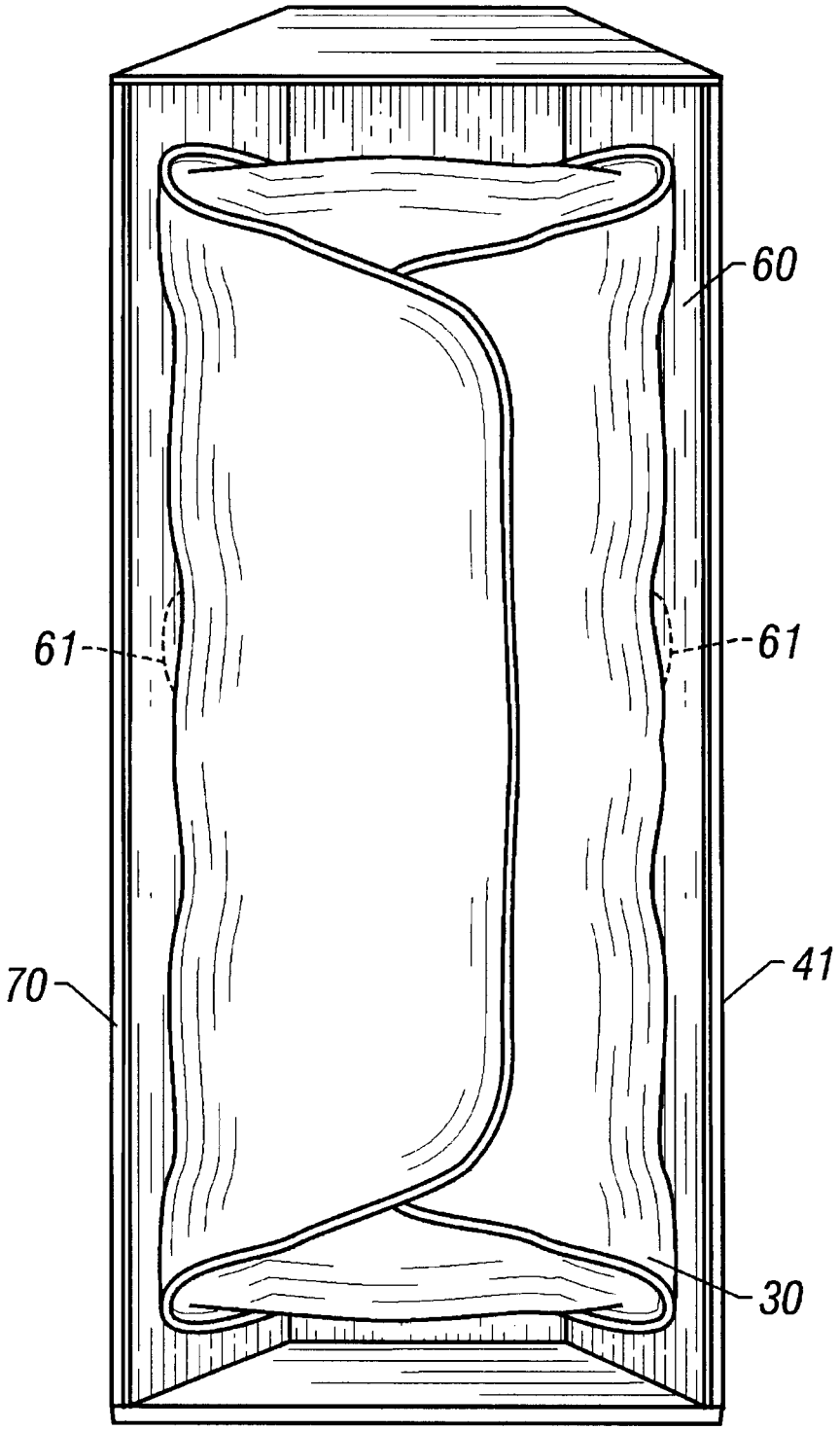

Referring to FIG. 6A and FIG. 6B, the present invention is contemplated to be a microwaveable food container. It is known in the art that microwaveable containers contain a mechanically formed weakness in a seal of the container that ruptures and vents the container when hot gases within the container cause the interior pressure and/or to exceed a desired pressure or temperature 80. As is well known to those skilled in the art, that as the pressure inside the sealed container 10 rises, the temperatures of vapors inside the sealed container 10 also rises. Typically, a number of vents 61 are positioned on the susceptor which rupture and vent the container during cooking. Microwaveable containers also contain a microwave susceptor surface 60 positioned as an inner surface of the container. The susceptor surface is a substrate having a microwave-absorptive coating region that is typically adjacent to the food item. In the present invention, a thermal insulating surface, positioned outside of the susceptor surface, is added to a portion or all of the microwaveable food container.

The susceptor 60 of the present invention is formed by a substrate upon which a coating for absorption of microwave radiation is deposited, printed, extruded, sputtered, evaporated, or laminated. The susceptor may include a pattern that is specific for the food item to heat evenly. Various patterns include, but are not limited to square matrix, shower flower, hexagonal, slot matrix and or concentric circles. It is also envisioned that the substrate may include a second coating for reflection of a portion of the microwave radiation to which the susceptor is exposed. By varying the reflectivity of coating, a membrane is created which is selectively permeable to microwave energy-i.e., it has the ability to control the amount of microwave energy reaching the absorbing coating. It is also envisioned that the substrate may comprise a third coating for shielding. Any method for applying microwave absorbing and reflecting coatings can be used, provided the method does not damage the substrate upon which the coatings are being deposited during the deposition process. See U.S. Pat. Nos. 5,254,821, and 5,038,009, which are incorporated herein by reference. Thus, as used herein, the term susceptor 60 refers to a substrate having a microwave-absorptive layer, a shielding layer, a reflective layer, or any combination thereof to produce the desired heating requirements for any given food item. On such combination includes one coating that contains a microwave-absorptive abilities, reflective abilities and shielding abilities. Yet further, the susceptor is variable in design depending upon the container type or shape.

The substrate preferably comprises an electrical insulator, e.g. a polymeric film. Materials considered to be useful as the substrate include, for example, but are not limited to polyolefins, polyesters, polyamides, polyimides, polysulfones, polyether ketones, cellophanes, and various blends of such materials. Other non-conducting substrate materials such as paper and paper laminates, metal oxides, silicates, and cellulosics can be used as well.

A variety of electrically conductive materials can be used for the absorbing coating, for example, a single metal, a metal alloy, a metal oxide, a mixture of metal oxides, a dispersion of conductive metallic or non-metallic materials in a binder, or any combination of the foregoing. Suitable exemplary metals include aluminum, iron, tin, tungsten, nickel, stainless steel, titanium, magnesium, copper and chromium. Suitable exemplary metal oxides include oxides of aluminum, iron, and tin, however, if not electrically conductive, (for example, aluminum oxide), they must be used in combination with an electrically conductive material.

Generally, the conductive materials are suspended or dispersed into a vehicle to allow for ease of coating the substrate. Suitable exemplary dispersion materials include carbon black, graphite, powdered metals, and metal whiskers. In a preferred embodiment, the absorbing coating is suspended in an appropriate vehicle having the viscosity necessary for proper transfer in a press inking system. This combination is also referred to as susceptor ink.

It is also contemplated that the susceptor include a selectively permeable reflecting coating. Examples of such coatings include, but are not limited to metals or metallic alloys, oxides or mixtures thereof either alone, or as a dispersion in a binder.

The microwave shielding layer attenuates microwave energy to spread microwave transmission more evenly within the container 10, and minimizes contact of microwave energy with the food item 30. Suitable metallized microwave shielding materials are disclosed in U.S. Pat. No. 5,300,746, which is incorporated herein by reference.

In another specific embodiment of the present invention, a thermal insulating surface is used to protect the food item and/or to protect the consumer. The thermal insulating surface is positioned outside the susceptor 60 and may cover the entire container or only a portion of the container. Thus, the container can be fully insulated to protect the food item from thawing pre-maturely or warming pre-maturely. Alternatively, the container can be partially insulated, for example as shown in FIGS. 5A, 5B, in which the portion of the container held by the consumer is insulated to protect the consumer from being burned when holding the container. Suitable materials for the thermal insulting surface preferably include materials that are capable of being stored and microwaved, and stored and handled at temperatures typical for frozen and/or chilled foods that can also be cooked in the package or container. One such material that may be used is a thermoplastic synthetic resin. See U.S. Pat. No. 4,435,344, which is incorporated by reference.

It is envisioned that the thermal insulating surface may be positioned in a variety of places within or outside the container. For example, the thermal insulating surface 70 may be positioned on the outside of the container 10. Typically, the outside of the container may be coated or laminated with a thermoplastic synthetic resin film or any other known thermal insulating surface. It is envisioned that the thermal insulating layer may cover the entire outside of the container or only a portion of the container, such as part 41, in order to provide a non-heated area of the container 10 for holding by a consumer.

Alternatively, the thermal insulating surface may be on the inside of the container, such that the thermal insulating surface is positioned between the wall of the container and the susceptor. Yet further, the container itself may be formed using a thermal insulating surface.

In another embodiment of the present invention, the container may further include graphics on the outside or inside of the container. It is envisioned that the graphics are printed on the outside of the container using thermotropic ink to display or provide instructions for handling the food item. Thermotropic inks change color at elevated temperatures or temperature changes. Any thermotropic ink and method for applying thermotropic ink can be used in the present invention, provided that the ink used is capable of being stored and handled at temperatures typical for frozen and/or chilled foods. See U.S. Pat. Nos. 4,155,895, which is incorporated herein by reference.

Figure 7A:
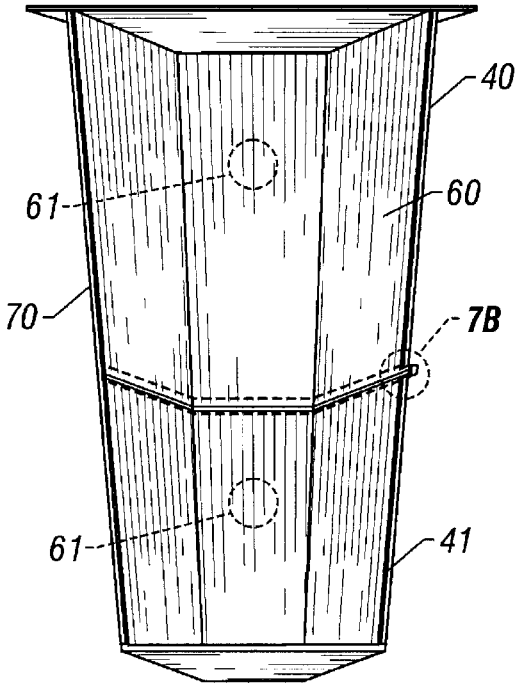
FIG. 7A and FIG. 7B illustrate a cross-sectional of the container and a detail of the tear-strip.
Figure 7B:
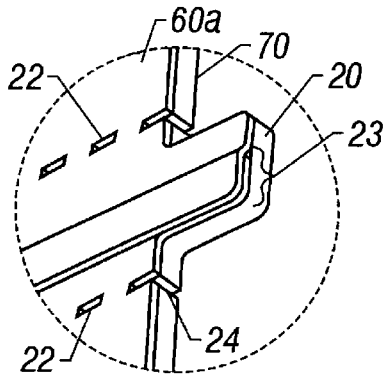
Figure 8A:
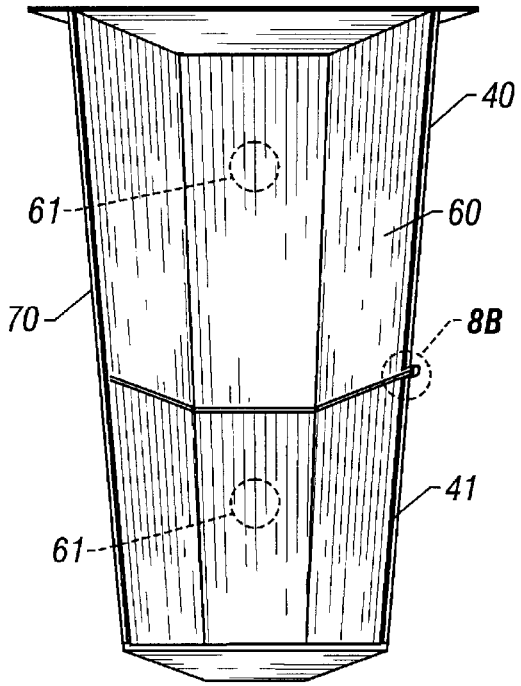
FIG. 8A and FIG. 8B illustrate a cross-sectional of the container and a detail of an alternate embodiment of a tear-strip.
Figure 8B:
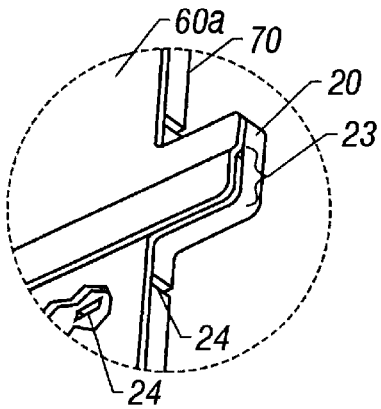

FIG. 7 and FIG. 8 illustrate alternate embodiments of the tear-strip 21 of the present invention. FIG. 7B and FIG. 8B show the tear-strip 21 having a double layer of substrate material 23 positioned along the desired tear-line on the inner surface 60*a* of the substrate 60. The double layer of substrate material 23 provides additional support to the tear-strip 21. Support of the tear-strip 21 ensures that the tear-strip does not break prematurely before the container is opened. Thus, it is apparent that a thin substrate material may require a double layer of substrate to increase support of the tear-strip. However, a thick substrate material may not require a double layer of substrate for support of the tear-strip. The tear-strip 21 is connected to the gripping tab 20 on the outside of the containing for releasing the tear-strip.

FIG. 7B shows a specific embodiment of the tear-strip 21 having stenciled markings 22 on the inner surface 60*a* of the substrate 60. The stenciled markings are perforation markings, which increase the ease of separating the container. In a preferred embodiment, the outside of the container can also contain a perforation marking 24.

In an alternative embodiment, as shown in FIG. 8B, the tear-strip 21 only has perforations 24 on the outer surface of the container. Thus, the substrate 60, which is not perforated, tears or rips when the tear-strip 21 is pulled to separate the container.

Figure 9A:
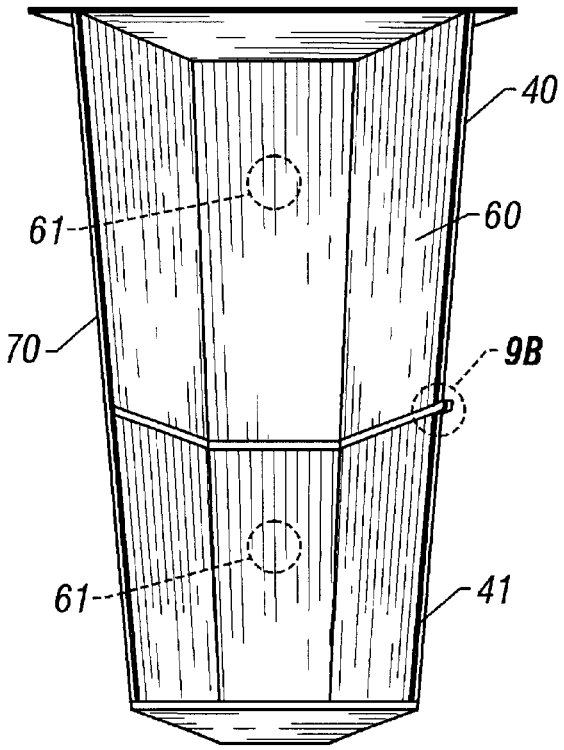
FIG. 9A and FIG. 9B illustrate a cross-sectional of the container and a detail of an alternate further embodiment of a tear-strip.
Figure 9B:
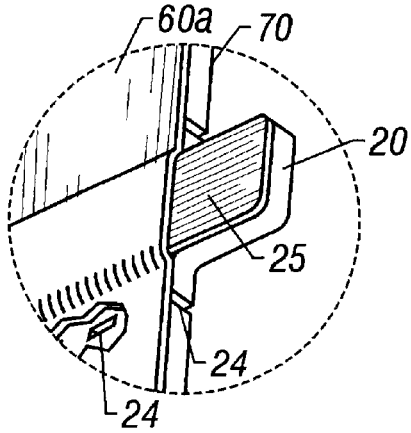

Another alternative is shown in FIG. 9A and FIG. 9B. In this embodiment, the substrate on the inner surface 60*a* of the container includes a thread or strip 25 disposed or embedded within the substrate, which is also connected to a gripping tab 20 on the outside of the container. In a preferred embodiment, the outside of the container also contains a perforation marking 24.

Although the present invention and its advantages have been described in detail, it should be understood that various changes, substitutions, and alterations can be made herein without departing from the spirit and scope of the invention as defined by the appended claims. As one of ordinary skill in the art will readily appreciate from the disclosure of the present invention, processes, manufacture, compositions of matter, means, methods, or steps presently existing or later to be developed that perform substantially the same function or achieve substantially the same result as the corresponding embodiments described herein may be utilized according to the present invention. Accordingly, the appended claims are intended to include within the scope of such processes, manufacture, compositions of matter, means, methods, or steps.

What is claimed is:

1. A container for cooking a food item using microwaves comprising:

a sealed container for microwave cooking;

a mechanically formed weakness in a seal of the container which ruptures and vents the container when hot gases within the container cause the interior pressure to exceed a desired pressure;

a microwave susceptor surface positioned as an inner surface of said container, comprising a substrate having a microwave-absorptive coating region; and a thermal insulating surface that is separate from the susceptor, wherein said thermal insulating surface protects a consumer from being burned when handling said container after cooking of said food item.

2. The container of claim 1 further comprising a tear-strip at least partially encircling said container which is connected to a gripping tab at an end of the tear-strip.

3. The container of claim 2, wherein said tear-strip separates the container into two parts in which at least one part is used as a receptacle for said food item.

4. The container of claim 2, wherein said tear-strip opens the container which is used as a receptacle for said food item.

5. The container of claim 1, wherein said microwave-absorptive region is deposited, printed, extruded, or laminated on said substrate.

6. The container of claim 1 further comprising a tear-strip having a double layer of substrate which is connected to a gripping tab on the outside of the container.

7. The container of claim 6, wherein at least one layer of substrate of the double layer of substrate comprises a perforation marking.

8. The container of claim 7 further comprising perforation markings on the outer surface of said container.

9. The container of claim 1 further comprising a tear-strip having a thread or a strip disposed within the substrate which is connected to a gripping tab on the outside of the container.

10. The container of claim 9 further comprising perforation markings on the outer surface of said container.

11. The container of claim 1, wherein said thermal insulating surface forms said container.

12. The container of claim 1, wherein said thermal insulating surface is positioned outside said susceptor surface of said container.

13. The container of claim 1, wherein said thermal insulating surface is positioned on only a portion of said container.

14. The container of claim 1, wherein said thermal insulating surface is positioned inside said container.

15. The container of claim 1, wherein said thermal insulating surface protects said food item from thawing prematurely.

16. The container of claim 1 further comprising graphics on the outside of said container, wherein said graphics are printed with thermotropic ink.

17. The container of claim 16, wherein said graphics provide instructions for handling said food item.

18. The container of claim 1, wherein the food item is a pet food.

19. The container of claim 1, wherein said container is a hand-held, portable container which is held in one hand during eating of said food item.

20. The container of claim 1, wherein said container is a polyhedron, cylinder, sphere, ellipsoid, or a variant thereof.

21. A container for cooking a food item using microwaves comprising:

a sealed container for microwave cooking a mechanically formed weakness in a seal of the container which ruptures and vents the container when hot gases within the container cause the interior pressure to exceed a desired pressure;

a microwave susceptor surface positioned as an inner surface of said container, comprising a substrate having a microwave-absorptive coating region;

a thermal insulating surface which protects the consumer from being burned from the hot item after cooking in a microwave oven, wherein said insulating surface is separate from the susceptor surface; and a tear-strip easy open device, wherein the tear-strip allows for easy and convenient access to the food item after cooking in a microwave oven.

22. The container of claim 21, wherein said microwave-absorptive region is deposited, printed, extruded, or laminated on said substrate.

23. The container of claim 21, further comprising graphics on the outside of said container, wherein said graphics are printed with thermotropic ink.

24. The container of claim 23, wherein said graphics provide instructions for handling said food item.

25. A hand-held microwaveable food package comprising:

a microwave susceptor surface positioned as an inner surface of said package, comprising a substrate having a microwave-absorptive coating region; and a thermal insulating surface which protects the consumer while handling said package after removal from a microwave oven, wherein said insulating surface is separate from the susceptor surface.

26. The package of claim 25, further comprising a tear-strip easy open device, wherein the tear-strip allows for easy and convenient access to the food item after cooking in a microwave oven.

27. The package of claim 25, wherein said microwave-absorptive region is deposited, printed, extruded, or laminated on said substrate.

* * * * *